US008133133B2

(12) United States Patent
Gilbert et al.

(10) Patent No.: US 8,133,133 B2
(45) Date of Patent: Mar. 13, 2012

(54) FORGED IRON-TYPE GOLF CLUBS

(75) Inventors: Peter J. Gilbert, Carlsbad, CA (US); Michael Scott Burnett, Carlsbad, CA (US); Thomas Orrin Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/780,695

(22) Filed: Jul. 20, 2007

(65) Prior Publication Data

US 2008/0015048 A1 Jan. 17, 2008

Related U.S. Application Data

(63) Continuation of application No. 10/964,239, filed on Oct. 13, 2004, now abandoned, which is a continuation-in-part of application No. 10/640,537, filed on Aug. 13, 2003, now abandoned.

(51) Int. Cl.
*A63B 53/02* (2006.01)
*A63B 53/04* (2006.01)

(52) U.S. Cl. ..... 473/312; 473/350

(58) Field of Classification Search ..... 473/305–350
See application file for complete search history.

(56) References Cited

U.S. PATENT DOCUMENTS

| | | | | |
|---|---|---|---|---|
| 1,953,604 | A * | 4/1934 | Heller | 473/310 |
| 4,420,156 | A | 12/1983 | Campau | 273/77 |
| 4,854,583 | A * | 8/1989 | Kobayashi | 473/312 |
| 4,928,972 | A | 5/1990 | Nakanishi et al. | 273/78 |
| 4,930,781 | A | 6/1990 | Allen | 273/167 |
| 5,181,720 | A | 1/1993 | Stites, III et al. | 273/80.2 |
| 5,205,553 | A * | 4/1993 | Okumoto et al. | 473/312 |
| 5,232,224 | A | 8/1993 | Zeider | 273/167 |
| 5,312,106 | A | 5/1994 | Cook | 273/169 |
| 5,346,217 | A | 9/1994 | Tsuchiy et al. | 273/167 |
| 5,429,353 | A | 7/1995 | Hoeflich | 273/77 |
| 5,429,357 | A | 7/1995 | Kobayashi | 273/80.2 |
| 5,460,371 | A | 10/1995 | Takeda | 273/80.2 |
| 5,549,297 | A | 8/1996 | Mahaffey | 473/290 |
| 5,556,097 | A | 9/1996 | Endo et al. | 473/309 |

(Continued)

FOREIGN PATENT DOCUMENTS

JP 11319157 11/1999

OTHER PUBLICATIONS

Mizuno 2003 Golf Collection.

(Continued)

*Primary Examiner* — Alvin Hunter
(74) *Attorney, Agent, or Firm* — Michael J. Mancuso

(57) ABSTRACT

Forged cavity back iron-type clubs and oversize clubs are disclosed. These forged clubs have thin, durable hitting face and relatively large cavity volumes. These clubs have high rotational moments of inertia to minimize distance and accuracy penalties associated with off-center hits. Long irons with hitting face of about 0.100 inch thick are achievable by the present invention. Also disclosed are forged irons made from stainless steels and annealed to achieve the desired hardness and ductility. Further, an interchangeable pin suitable for use in the manufacture of any of a set of iron-type clubs without re-tooling is disclosed. The pin is sized and configured to fit within a through-bore such that an adhesive such as a flexible epoxy may be placed within the gaps to provide a vibration dampening effect.

16 Claims, 15 Drawing Sheets

U.S. PATENT DOCUMENTS

| | | | | |
|---|---|---|---|---|
| 5,611,742 | A | 3/1997 | Kobayashi | 473/345 |
| 5,702,310 | A | 12/1997 | Wozny | 473/308 |
| 5,716,288 | A | 2/1998 | Sacco | 473/290 |
| 5,722,901 | A | 3/1998 | Barron et al. | 473/305 |
| 5,823,887 | A | 10/1998 | Mikame et al. | 473/290 |
| 5,947,841 | A | 9/1999 | Silvestro | 473/341 |
| 5,967,903 | A | 10/1999 | Cheng | 473/342 |
| 6,001,027 | A | 12/1999 | Hansberger | 473/306 |
| 6,045,456 | A | 4/2000 | Best et al. | 473/291 |
| 6,050,903 | A | 4/2000 | Lake | 473/244 |
| 6,071,198 | A * | 6/2000 | Nishizawa et al. | 473/291 |
| 6,071,200 | A | 6/2000 | Song | 473/345 |
| 6,638,178 | B2 * | 10/2003 | Tseng | 473/306 |
| 6,769,998 | B2 * | 8/2004 | Clausen et al. | 473/342 |
| 7,137,905 | B2 * | 11/2006 | Kohno | 473/314 |
| 7,153,222 | B2 * | 12/2006 | Gilbert et al. | 473/349 |
| 2005/0037863 | A1 * | 2/2005 | Gilbert et al. | 473/349 |

OTHER PUBLICATIONS

1992 Hogan.
Kenneth Smith Clubs.

* cited by examiner

FIG. 11: Cavity Volume
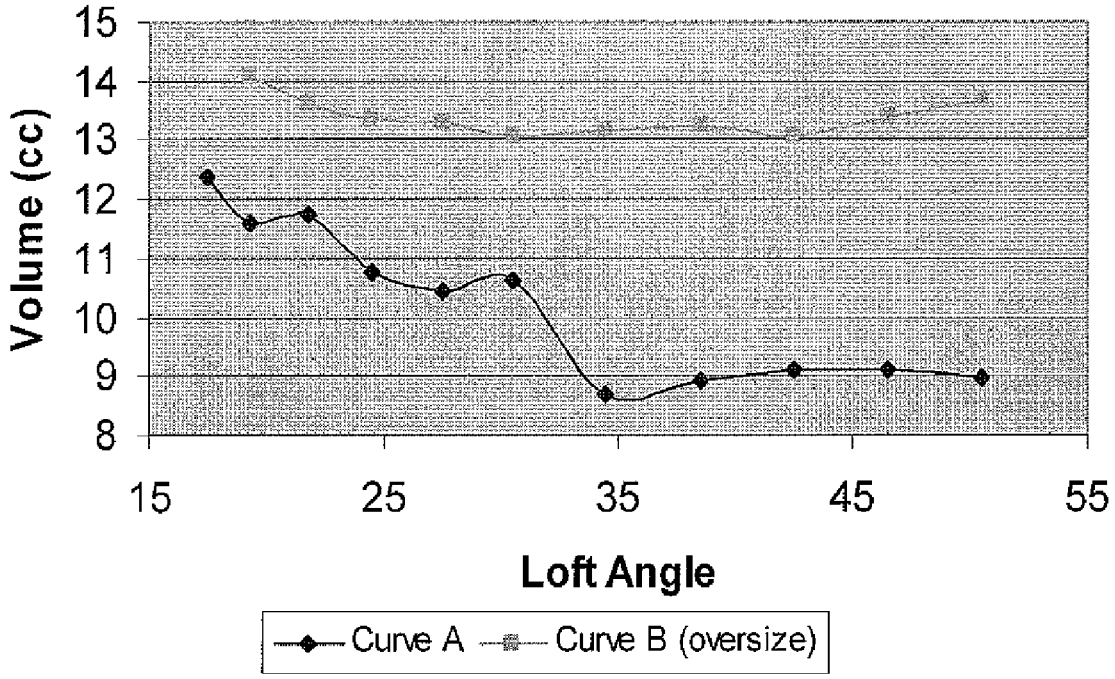
FIG. 12: Area of Hitting Zone
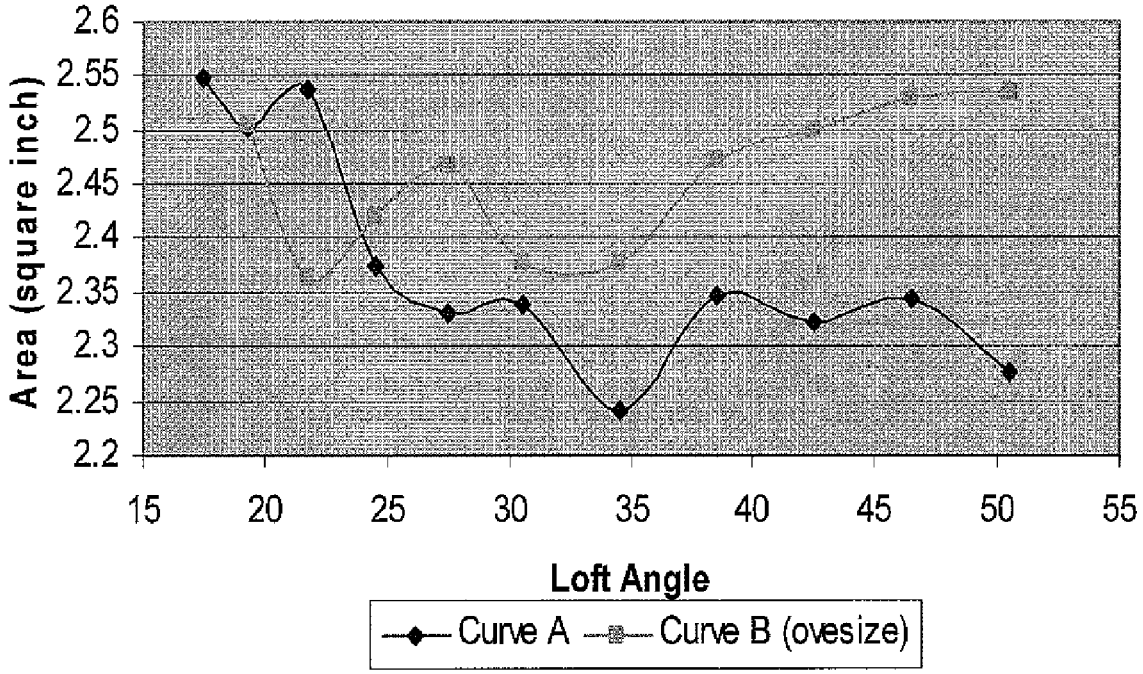

FIG. 13: Hitting Zone Thickness
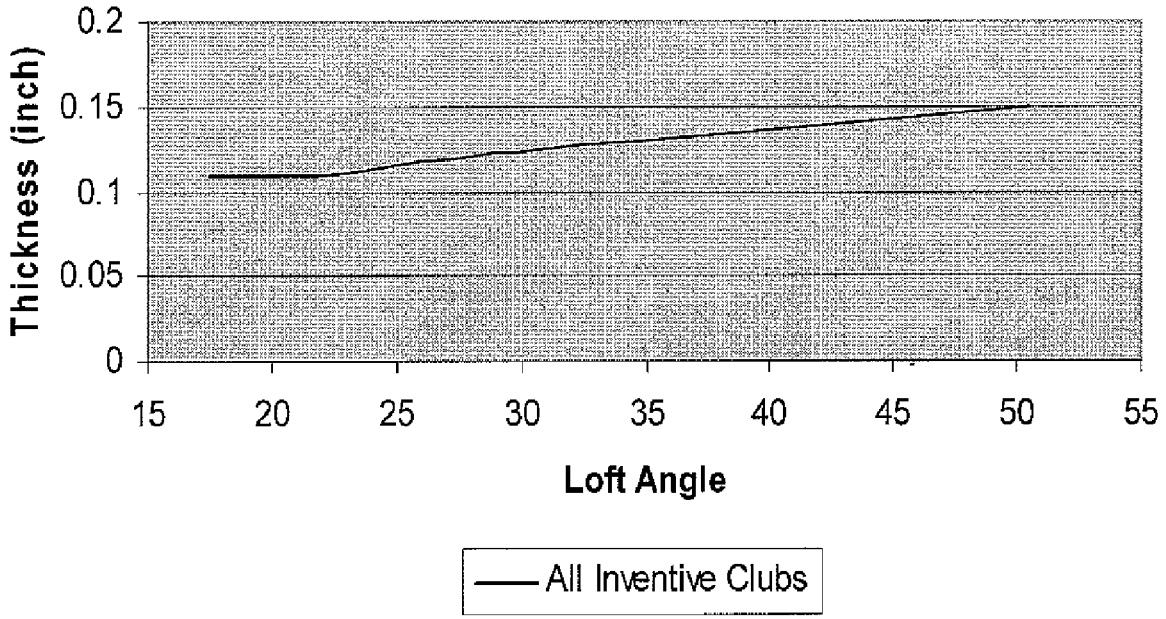
FIG. 14: Aspect Ratio
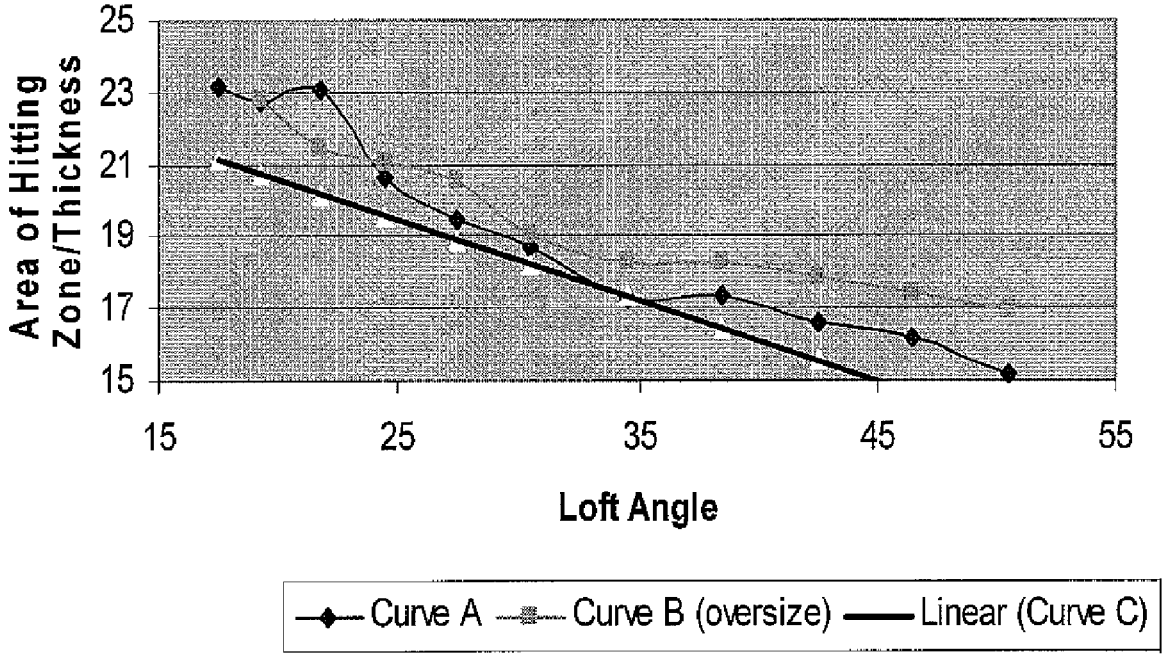

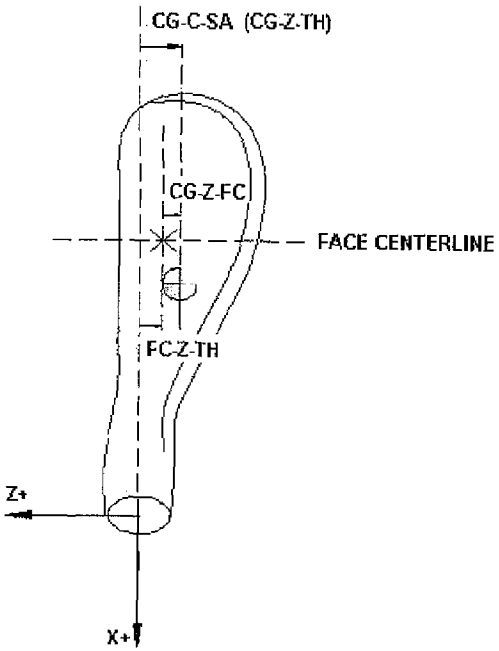
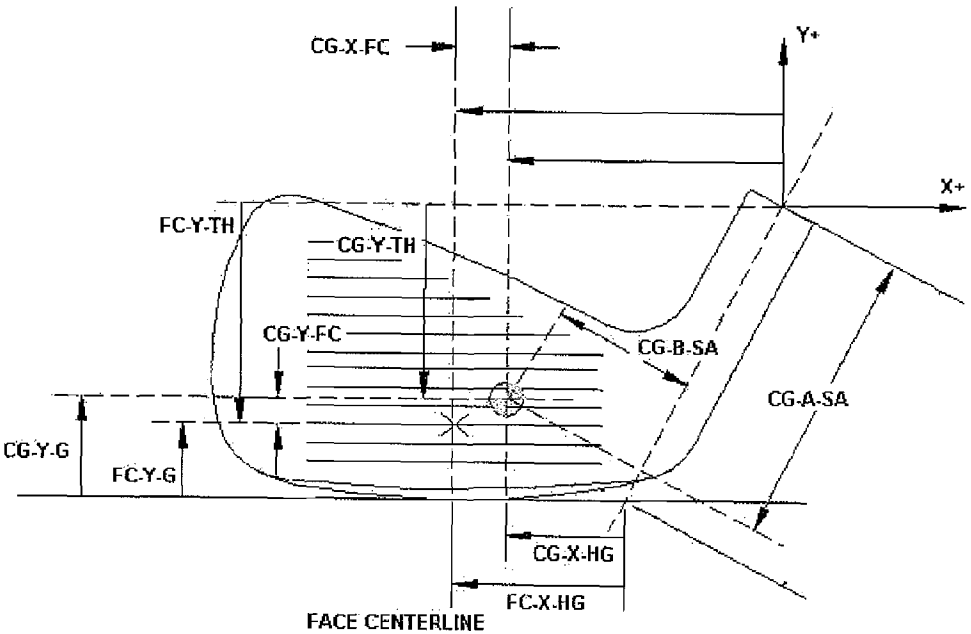
FIG. 21

FORGED IRON-TYPE GOLF CLUBS

CROSS-REFERENCE TO RELATED APPLICATION

The present application is a continuation of U.S. application Ser. No. 10/964,239 filed on Oct. 13, 2004 now abandoned, which is a continuation-in-part of U.S. application Ser. No. 10/640,537 filed on Aug. 13, 2003 now abandoned, the disclosures of which are incorporated herein by reference in their entirety.

FIELD OF THE INVENTION

This invention generally relates to golf clubs, and, more particularly, to iron-type clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity back constructions for increased perimeter weighting. Perimeter weighting also provide the club head with higher rotational moment of inertia about its center of gravity. Club heads with higher moment of inertia have a lower tendency to rotate caused by off-center hits. Another recent trend has been to increase the overall size of the club heads, especially in the long irons. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become more difficult for the average golfer to swing properly.

In general, the center of gravity of these clubs is moved toward the bottom and back of the club head. This permits an average golfer to get the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

Iron-type clubs, which include wedge clubs, are typically made by investment casting, machining or forging. Forged club heads are coveted by the higher skilled amateur golfers and professionals for its superior playing characteristics. On the other hand, forgeable alloys are malleable and typically have low yield strengths. For forged clubs, the face of the club cannot heretofore be made thin, because of this drawback.

Commercially available forged iron-type clubs are typically the muscle-back type, such as the Titleist® Forged 670, 680 and 690 series, Mizuno's MP-33 irons and Kenneth Smith's Royal Signet clubs. The Royal Signet® muscle-back clubs concentrate the club weight near the center sweet spot, thereby reducing its moment of inertia. Forged cavity back iron-type clubs are also available, as midsize clubs with relatively thicker hitting face, such as the Titleist® 690-CB, the Hogan Apex Edge Pro or the Royal Signet® Titanium. The Hogan Apex Edge Pro irons are single-piece clubs forged from carbon steel, but the Hogan CFT clubs have a stamped titanium face in a cast body. The Royal Signet® Titanium clubs are cast stainless steel clubs with a forged titanium full face insert for additional strength.

Hence, a need still exists for improved forged iron-type golf clubs.

SUMMARY OF THE INVENTION

The present invention is directed to golf club head comprising a hosel and a bore extending from the hosel to a sole of the club head. The density of a pin disposed in the bore is less than the density of the club head.

The present invention is also directed to a golf club head comprising a hosel and a bore extending from the hosel to a sole of the club head. At least two dampening zones are defined in the bore.

The present invention is also directed to a golf club head having a bore extending through the heel of the club head, from the top of the hosel through the sole, and an elongated pin affixed within the bore using an adhesive. The pin includes a body having a body outer diameter, a base having a base outer diameter, which is smaller than the body outer diameter, and an extension having an extension outer diameter which is smaller than the body outer diameter. The geometric center of the extension is offset from the geometric center of the body. Further, the pin is positioned within the bore such that an upper gap is formed between the extension and an inner wall of the bore and a lower gap is formed between the base and the inner wall of the bore. The pin and bore are preferably keyed so that upon insertion the pin is clocked into the appropriate position. The upper gap and the lower gap are filled with adhesive.

The present invention is also directed to an iron-type golf club comprising a club head having a hosel, a front and a back, wherein the back comprises a cavity defined by a perimeter member and the front has a hitting zone located opposite to and coinciding with the cavity. The club head is forged from a malleable metal, such as stainless steel, and then preferably annealed. The forged club head further includes a bore extending through the heel of the club head, from the top of the hosel through the sole, and an elongated pin affixed within the bore using an adhesive. The pin includes a body having a body outer diameter, a base having a base outer diameter, which is smaller than the body outer diameter, and an extension having an extension outer diameter, which is smaller than the body outer diameter. The geometric center of the extension is offset from the geometric center of the body. Further, the pin is positioned within the bore such that an upper gap is formed between the extension and an inner wall of the bore and a lower gap is formed between the base and the inner wall of the bore. The upper gap and the lower gap are filled with adhesive.

The present invention is also directed to golf club head for an iron-type golf club comprising a hitting face, a sole, and a hosel A bore in a heel of the club head extends from the hosel to the sole, and a pin of lower density than the rest of the club head is disposed in the bore. Due to the pin, the mass of the club head is distributed such that a distance from a ground plane to a center of gravity of the club head as measured when the club head is in an address position is closer to the ground plane than the center of gravity of a similar club head without a bore.

BRIEF DESCRIPTION OF THE DRAWINGS

In the accompanying drawings, which form a part of the specification and are to be read in conjunction therewith and in which like reference numerals are used to indicate like parts in the various views:

FIG. 11 is a graph showing the cavity volume of the club heads in accordance with the present invention;

FIG. 12 is a graph showing the areas of the hitting zones of the club heads in accordance with the present invention;

FIG. 13 is a graph showing the exemplary minimum thickness of the hitting zones of the club heads in accordance with the present invention;

FIG. 14 is a graph showing the aspect ratios between the areas of the hitting zones of FIG. 12 and the minimum thickness of FIG. 13;

FIG. 21 is a schematic view of an iron club head showing positional and nomenclature conventions.

DETAILED DESCRIPTION OF THE PREFERRED EMBODIMENTS

Figure 1:
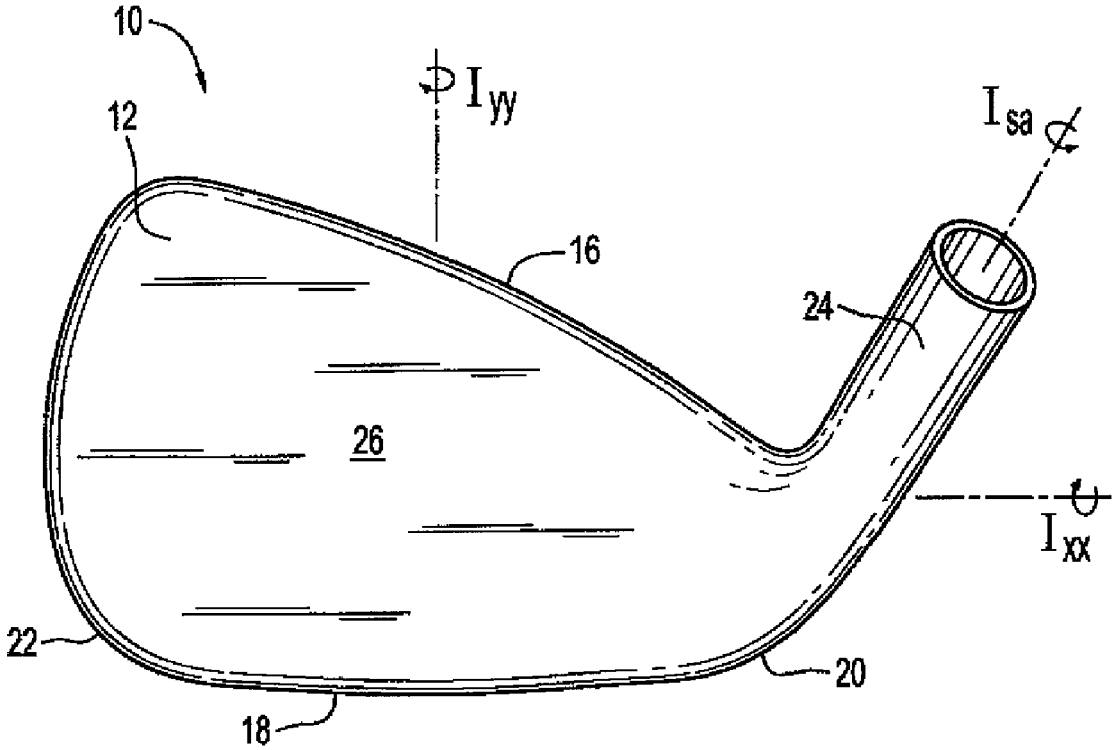
FIG. 1 is a front view of a club head in accordance with an embodiment of the present invention, with the grooves omitted for clarity.
Figure 2:
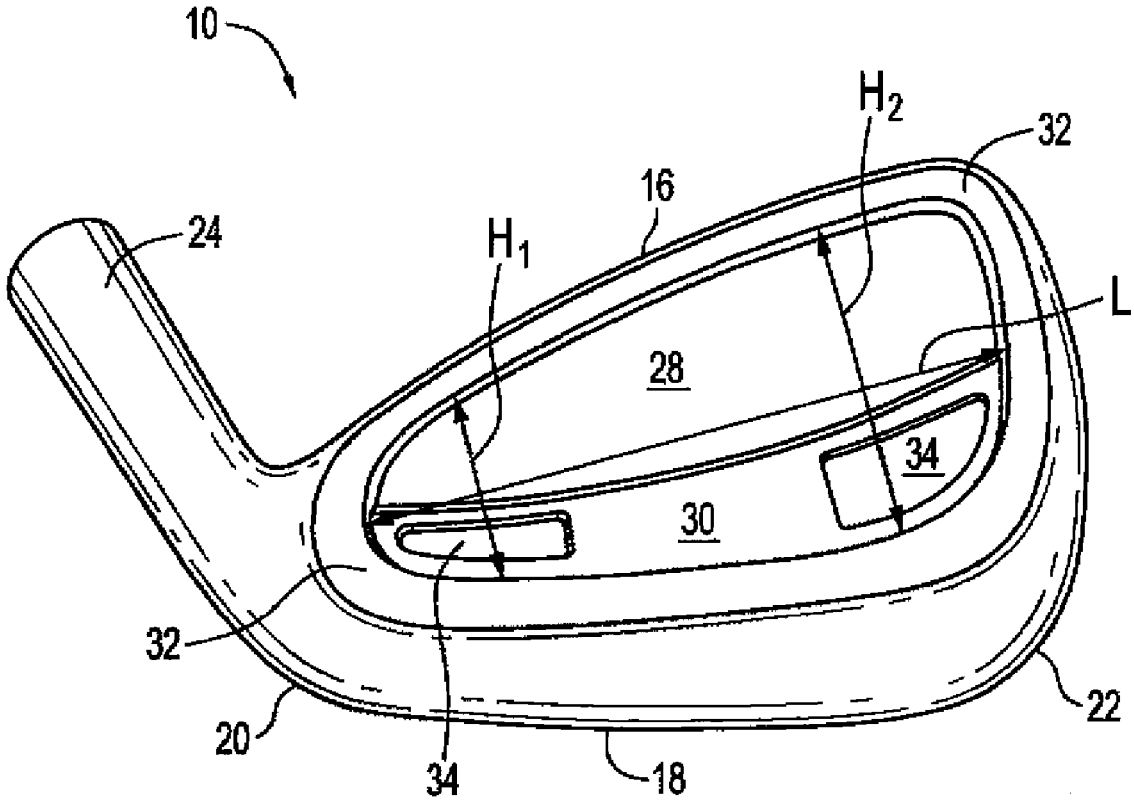
FIG. 2 is a back view of the club head of FIG. 1.
Figure 3:
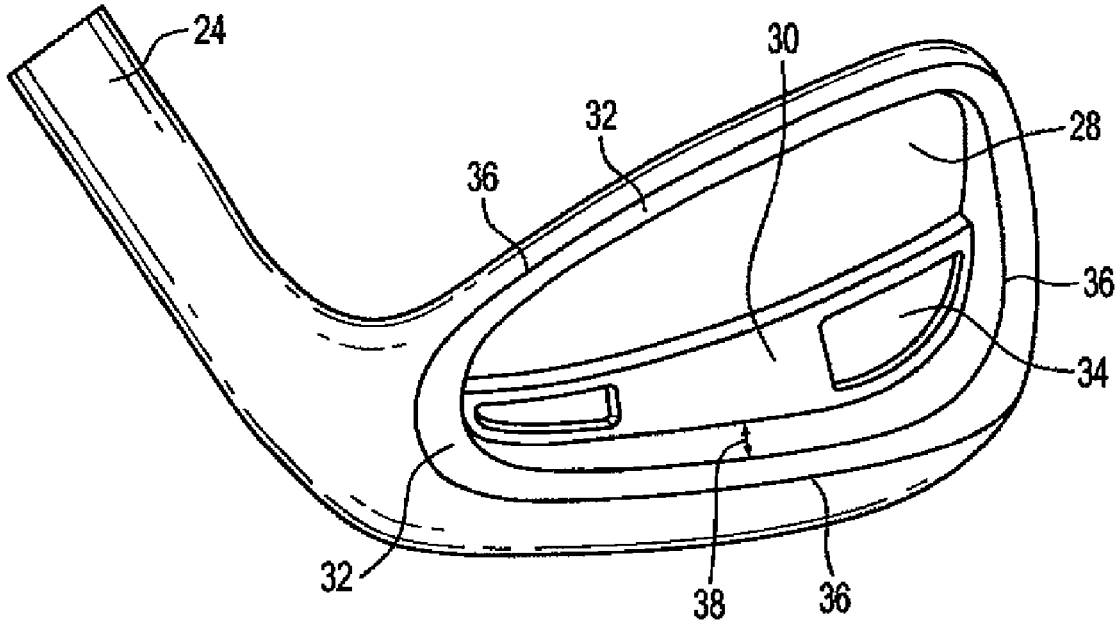
FIG. 3 is an isometric back view of the club head of FIG. 1.

Club head 10 in accordance with an embodiment of the present invention is illustrated in FIGS. 1-7. Club head 10 comprises front 12, back 14, top 16, sole 18, heel 20, toe 22 and hosel 24. The club head is a single-piece forging, i.e., it is forged from a single ingot and does not include a face insert, or it is formed from a stainless steel body and stainless steel insert. The body is forged and the face insert is forged or stamped. A shaft (not shown) is connected to the club head at hosel 24 and a grip (not shown) is provided at the top end of the shaft. The grooves on the front 12 are omitted from the figures for clarity. Front 12 comprises hitting zone 26, which preferably is defined by the rear cavity area and is located opposite to top portion 28 and reinforced portion 30 as best illustrated in FIGS. 2 and 3. Club head 10 is preferably a "cavity back" club, i.e., a substantial portion of the mass of the club head is positioned on the back side around perimeter 32 of the club head. As explained further below, the cavity back design provides the club with larger rotational moments of inertia to resist the club's tendency to rotate caused by off-center hits. However, a "muscle-back" club head is also appropriate for use with aspects of the present invention. Inside perimeter 32, top portion 28 is the thinnest member of hitting zone 26. The minimum thickness of front 12 is in top portion 28. Reinforced portion 30 is thicker than top portion 28 to provide some structural support to the hitting face. Taken together, top portion 28 and reinforced portion 30 resemble a traditional muscle-back forged club. Club head 10 also has a distinctive appearance of having a muscle-back within a cavity back. Reinforced portion 30 may have depressions 34 to provide the club with more distinctiveness.

Figure 4:
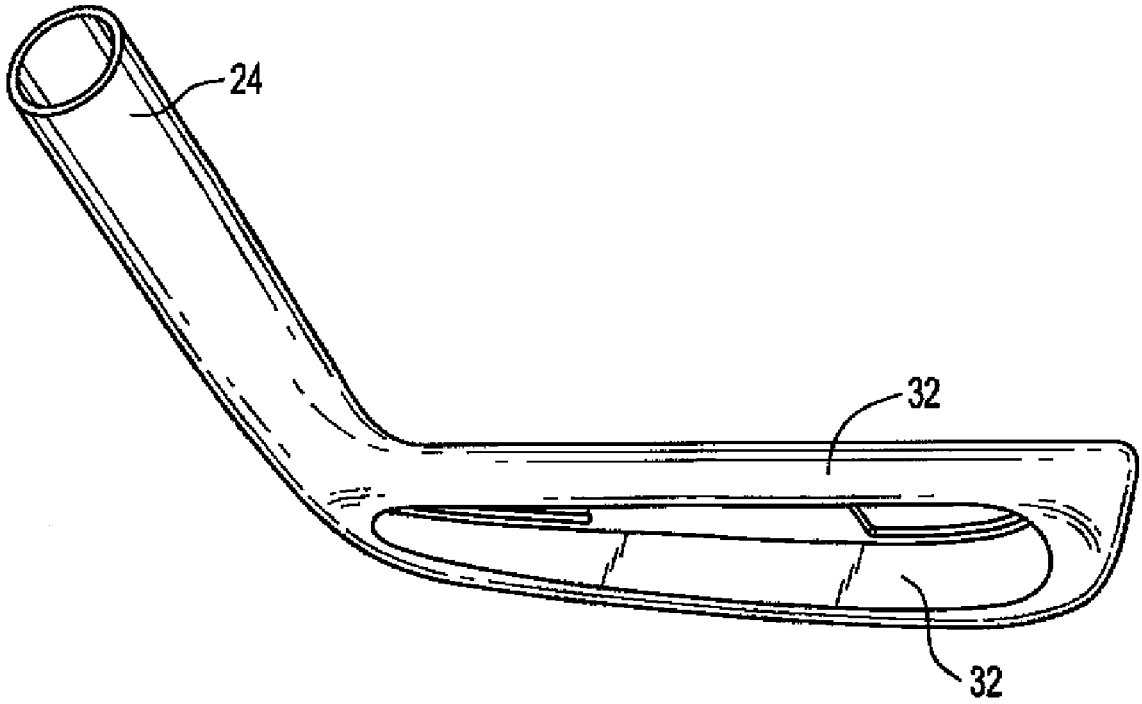
FIG. 4 is a top view of the club head of FIG. 1.
Figure 5:
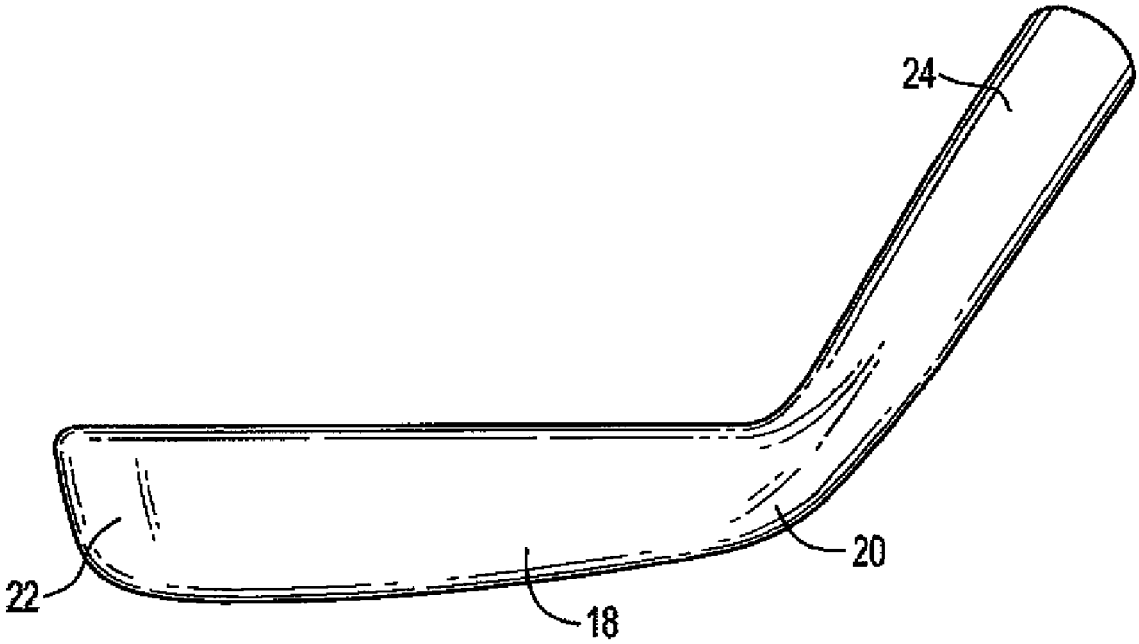
FIG. 5 is a sole view of the club head of FIG. 1.
Figure 6:
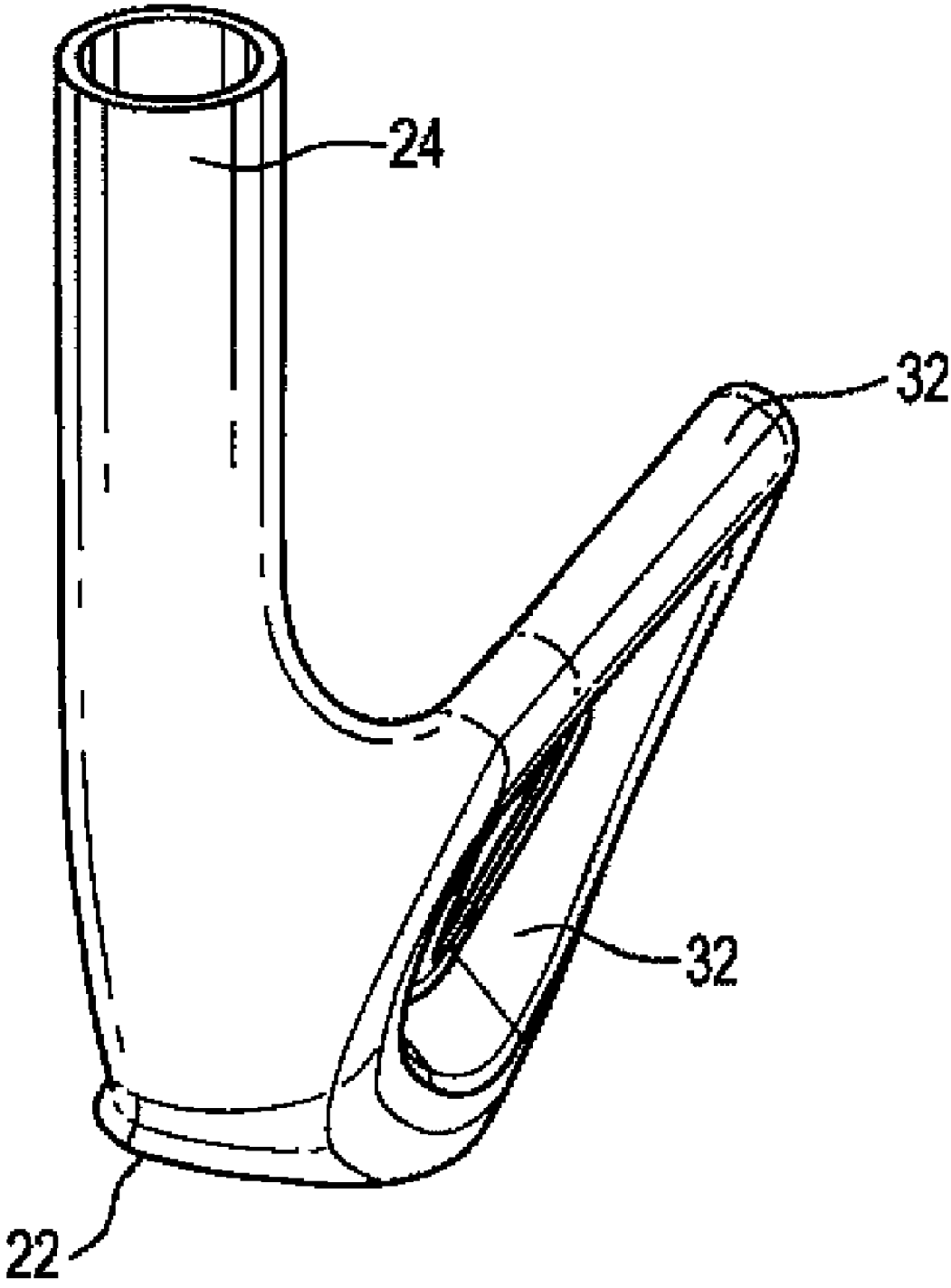
FIG. 6 is a heel view of the club head of FIG. 1.
Figure 7:
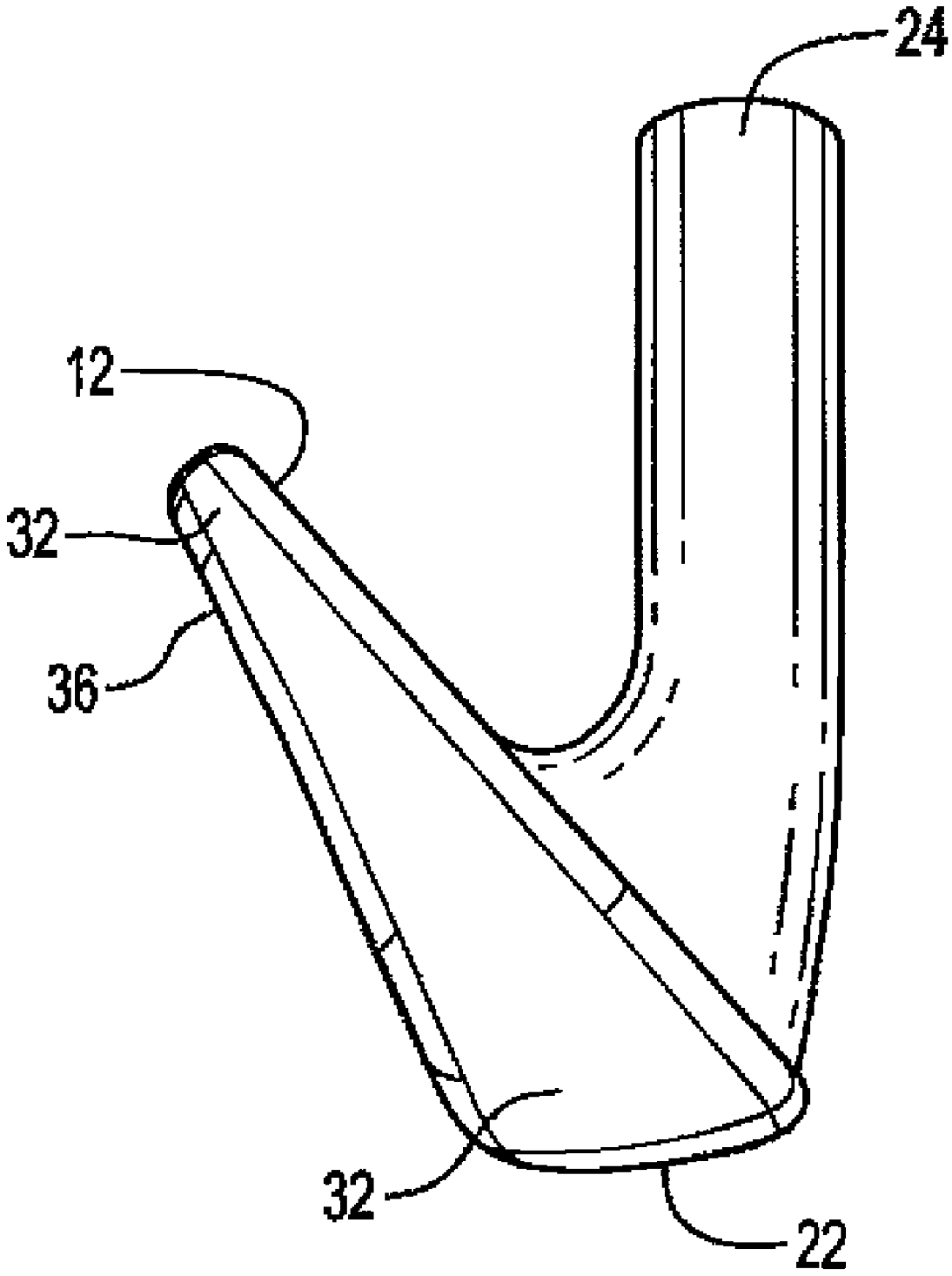
FIG. 7 is a toe view of the club head of FIG. 1.

Additionally, the mass distribution within perimeter 32 is biased toward sole 18, so that the center of gravity of club head 10 is both behind and below the geometric center of the face. The geometric center can be defined as the intersection of a vertical centerline and a horizontal centerline of front 12, or it can be defined as the midpoint of the grooves. As best illustrated in FIGS. 3, 4 and 7, the thickness at the top of perimeter 32 is substantially thinner than the thickness at the bottom of perimeter 32. When the center of gravity is below and behind the geometric center of the hitting face, the club can launch the golf ball to higher trajectory and longer flight distance.

Figure 8:
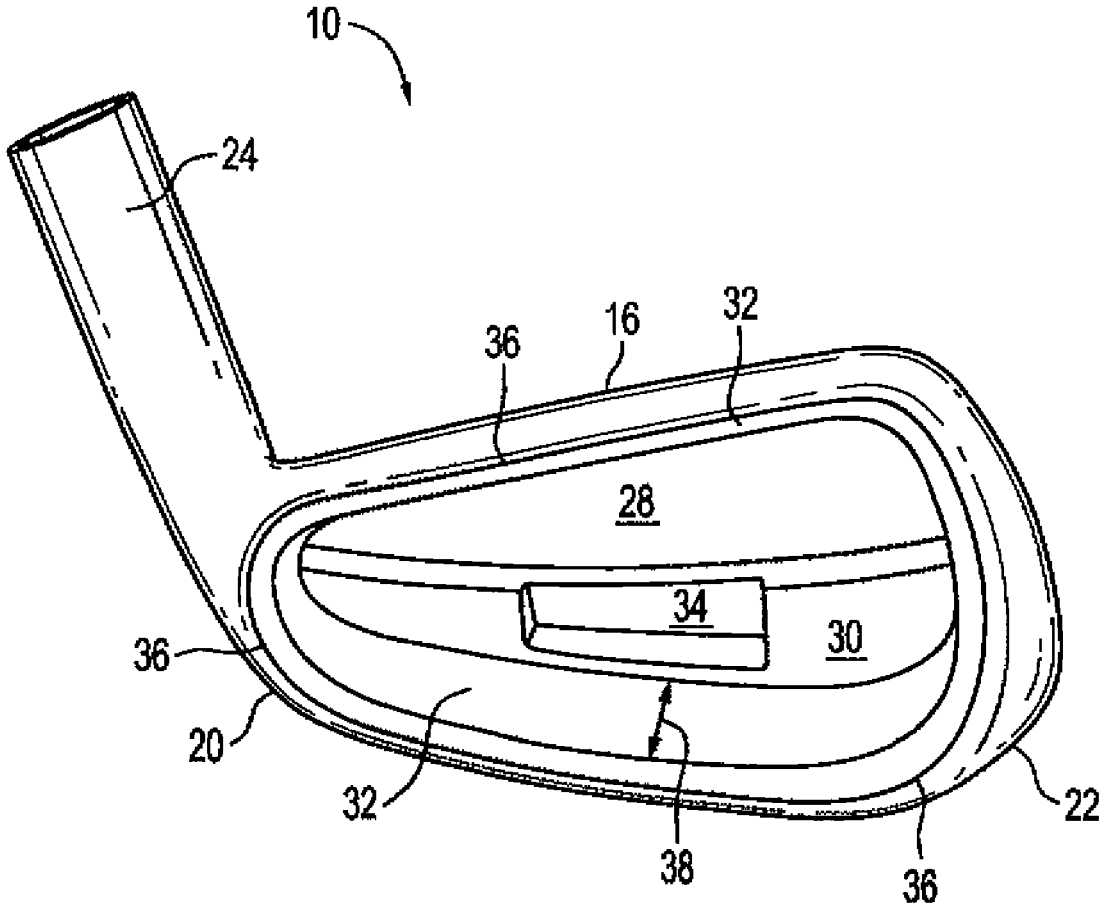
FIG. 8 is an isometric back view of a club head in accordance with another embodiment of the present invention.
Figure 15:
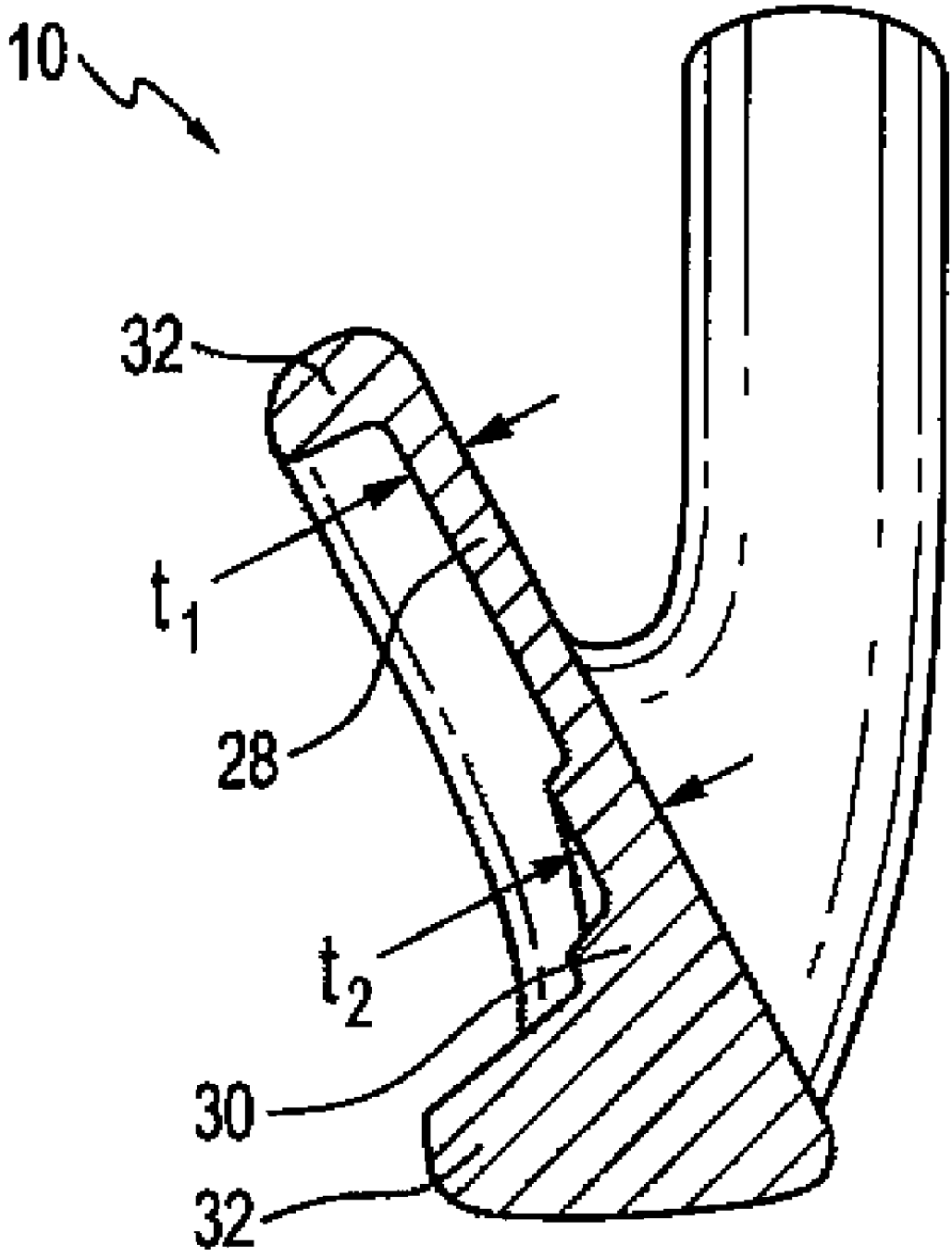
FIG. 15 is a cross-sectional view of the club of FIG. 8.

Another embodiment of the present invention is illustrated in FIG. 8. This embodiment is substantially similar to the embodiment of FIGS. 1-7, except that this club head is an "oversize" club head. As used herein, oversize club head includes, but is not limited to, club heads that are dimensionally larger than the traditional club heads, club heads that have larger "sweet-spots" than traditional club heads, and cavity back club heads that have a relatively higher cavity volume. Cavity volume is defined as the volume within a three-dimensional shape bounded by the surface of the back of hitting zone 26, i.e., the combined surfaces of portions 28 and 30, the inner surface of perimeter weight 32 and an imaginary planar or curvilinear plane formed by outer edge 36 of perimeter 32. Outer edge 36 is best illustrated in FIG. 7. The club head of FIG. 8 is the oversize version of the club head of FIGS. 1-7, because of the relative difference in cavity volumes. This cavity volume difference is best illustrated by the relative difference in thickness 38 of perimeter 32 shown in FIG. 3 and in FIG. 8. FIG. 15 illustrates a cross-sectional view of this club showing minimum thickness $t_1$ of top portion 28 and thickness $t_2$ of reinforced portion 30.

Table 1 below shows the preferred cavity volumes for the clubs in accordance with the present invention.

TABLE 1

Preferred Cavity Volumes

| | Inventive Clubs | | Inventive Oversize Clubs | |
|---|---|---|---|---|
| Club Type | Loft° | Cavity Volume ($cm^3$) | Loft° | Cavity Volume ($cm^3$) |
| 1 | 17.5 | 12.36 | | |
| 2 | 19.5 | 11.58 | 19.0 | 14.1 |

TABLE 1-continued

| Preferred Cavity Volumes | | | | |
|---|---|---|---|---|
| | Inventive Clubs | | Inventive Oversize Clubs | |
| Club Type | Loft° | Cavity Volume ($cm^3$) | Loft° | Cavity Volume ($cm^3$) |
| 3 | 22.0 | 11.75 | 21.5 | 13.62 |
| 4 | 25.0 | 10.78 | 24.0 | 13.35 |
| 5 | 28.0 | 10.45 | 27.0 | 13.31 |
| 6 | 31.0 | 10.64 | 30.0 | 13.05 |
| 7 | 35.0 | 8.68 | 34.0 | 13.18 |
| 8 | 39.0 | 8.92 | 38.0 | 13.24 |
| 9 | 43.0 | 9.10 | 42.0 | 13.05 |
| PW | 47.0 | 9.09 | 46.0 | 13.37 |
| SW | 51.0 | 8.96 | 50.0 | 13.66 |

The cavity volumes for these two embodiments of club head 10 are plotted in FIG. 11 as a function of the loft angle of the club head. As depicted in FIGS. 11, 13 and 14, curve A depicts the characteristics of the inventive clubs and curve B depicts the characteristics of the inventive oversize clubs. FIG. 11 readily shows that the cavity volume for the oversize clubs is always larger than the cavity volume for the other clubs. Furthermore, for clubs with loft angle (LA) less than about 32°, the cavity volume is greater than about 10 $cm^3$ (cc). The cavity volume is at least about 8 cc for all clubs. For the oversize clubs, the cavity volume is at least about 12 cc for all clubs, and preferably the cavity volume is greater than about 13 cc. Additionally, as discussed below, the larger cavity volumes of the inventive oversize clubs produce the desirable high rotational moment of inertia.

In accordance with one aspect of the present invention, malleable stainless steel is a preferred material for the forging process. Typically carbon steel had been used for forging due to its softness. However, because carbon steel rusts, the club head is chrome plated for protection. Chrome plating is not ductile and thus subject to cracking. This limits the lie, loft and bending ability of the club head. Chrome plating also limits the ability of golf club manufacturers to grind the finished head to customize weight, shape and/or sole configuration, since the thin chrome plating would be eliminated.

Preferred stainless steels have yield strength of less than about 90,000 psi and over about 13% in elongation. More preferably, the material has yield strength of less than about 85,000 psi and ultimate elongation of about 15% to about 21%. Preferred stainless steels also have a Rockwell Hardness of less than about 25 HRC (Hardness Rockwell C scale). Suitable stainless steels include the 410 stainless steel, which has the following chemical composition: 86.98% Fe, 11.3% Cr, 0.723% Mn, 0.366% Si, 0.297% Ni, 0.11% C, 0.034% P, 0.033% Cu, 0.03% Mo, 0.02% V, 0.017% S, and 0.01% Al. Another suitable stainless steel is the 403 stainless steel, which has the following chemical composition: 86% Fe, 12.3% Cr, max 1% Mn, max 0.5% Si, max 0.15% C, max 0.04% P and max 0.03% S.

A forged club head made from 410 stainless steel has a hardness in the range of about 14.2 to about 17.3 HRC. The forging process may comprise multiple forging steps, wherein each forging step is followed by other processing steps such as grinding, sandblasting, removing flash, and trimming, among others. For example, the forging process may have a primer forging step followed by grinding and/or sandblasting before multiple rough forging steps are carried out. More grinding and sandblasting can occur before the grooves are cut or stamped and fine forging steps are performed to finish the forging process.

In accordance with another aspect of the present invention, the forged club head is further treated by annealing (heating) to decrease its hardness to less than about 40 HRC and preferably less than about 90 HRB, more preferably about 80 HRB. In one embodiment, the hardness is annealed to between 20-40 HRC for durability. In a preferred embodiment, the club is made softer for customization and has a hardness less than about 90 HRB. In one example, the forged club head is heated to about 1050° C. for about 90 minutes and then to about 650° C. for about 120 minutes.

The post-forging heat treatment brings the hardness of the forged club head to any desired hardness. Advantageously, the increased hardness resolves the problem of the forged club head being too hard and being easily customized in loft and lie. The hardness of the annealed forged material is also advantageously in the same range as the hardness of the cast materials, e.g., cast 431 stainless steel or cast 8620 carbon steel, used in the high-end cast clubs, such as Titleist® DCI irons. The physical properties of these materials are shown below:

TABLE 2

| Physical Properties of Selected Materials | | | | | |
|---|---|---|---|---|---|
| Material | Density | Hardness | Tensile Strength (Ultimate) | Tensile Strength (Yield) | Elongation |
| 410 SS (forged & annealed) | 7.72 g/cm | 24 HRC-77 HRB | 97,000 psi | 70,000 psi | 16% |
| 403 SS (forged & annealed) | | | (same as 410 SS) | | |
| 416 SS (machined) | 7.64 | 21 HRC | 107,000 | 81,900 | 20% |
| 431 SS (cast) | 7.67 | 20-28 HRC | 95,000 | 60,000 | 18% |
| S20C (forged) | 7.87 | 85-95 HRB | 80,000 | 55,000 | 20% |
| 8620 (cast) | 7.75 | 85-90 HRB | 85,000 | 60,000 | 20% |

Hence, the present invention resolved the thick hitting face problem of forged irons by selecting a ductile or malleable forgeable stainless steel that is better than chrome-plated soft carbon steel and annealing the forged club head.

Figure 9A:
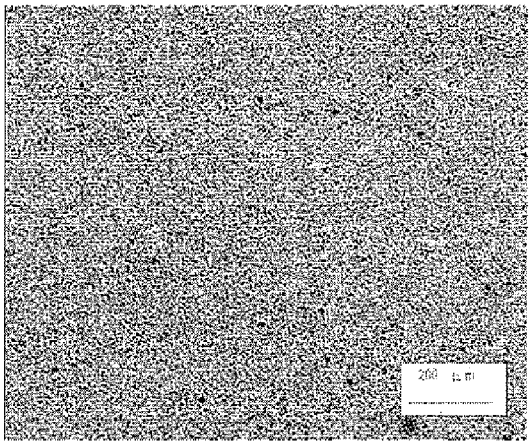
FIGS. 9(*a*) and 9(*b*) are magnified photographs of the microstructure of a forged material suitable for use in the club heads of the present invention.
Figure 9B:
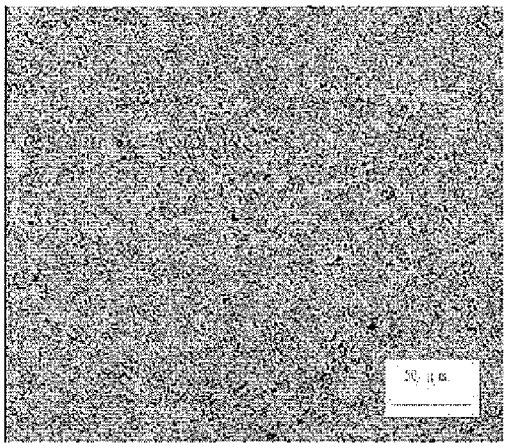
Figure 10A:
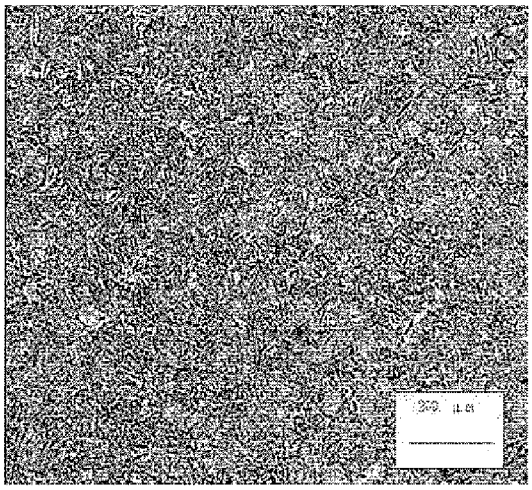
FIGS. 10(*a*) and 10(*b*) are magnified photographs of the microstructure of the forged material of FIGS. 9(*a*) and 9(*b*) after annealing.
Figure 10B:
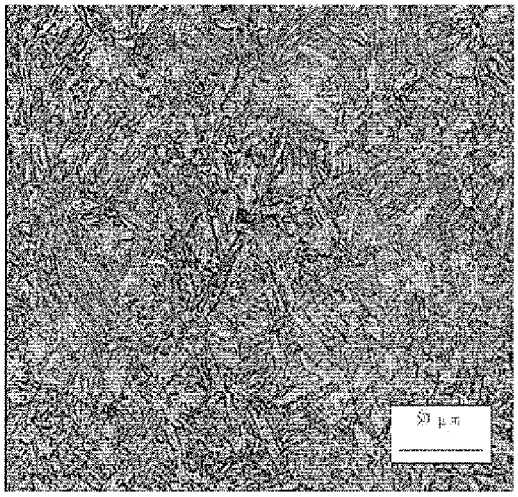

Another advantage realized by the annealing step is that the crystalline structure of the forged material improved. As illustrated in FIGS. 9(*a*) and 9(*b*), the microstructure of the forged club head comprises relatively small grain size, and as shown in FIGS. 10(*a*) and 10(*b*) the grain size has significantly increased. Metals with larger grain size microstructure have higher ductility. Preferably, the grain size is greater than about 10 μm to about 50 μm. As shown in the above table, the ductility of annealed and forged 410 SS has elongation properties approaching that of cast 431 SS. The chemical composition for 431 stainless steel is 82% Fe, 15-17% Cr, 1.25%-2.5% Ni, max 1% Mn, max 1% Si, max 0.2% C, max 0.04% P and max 0.03% S.

Additionally, the bending ability of forged and annealed 410 SS surpassed 17-4 PH SS, another commonly used metal for iron-type clubs and similar to cast 431 SS. Other suitable materials include, but are not limited to, forgeable 403 SS, 431 SS, 416 SS, 303 SS, 304 SS, 329 SS, 316 SS, 259 SS, Nitronic 40, Nitronic 50 and Nitronic 60. Suitable stainless steels have at least 10% Cr. The forging and annealing processes can readily be adjusted to reach the desirable hardness, tensile strength and ductility in accordance with the process described above.

The inventive iron-type clubs can have a hitting zone minimum thickness in the same range as the thickness of cast iron-type clubs. In one embodiment, the thickness of hitting zone 26 can be less than about 0.100 inch. The inventors of the present invention have produced clubs with a hitting zone as thin as about 0.098 inch for the long irons, i.e., the no. 1, 2 and 3 irons. In other embodiments, particularly in the two-piece embodiment, i.e., a forged body and a forged or stamped insert, the thickness can be as low as 0.060 inch.

The minimum thickness of hitting zone 26 can be characterized in terms of the clubs' aspect ratio, which is the ratio of hitting zone 26 over its minimum thickness. Referring to FIG. 2, the area of hitting zone 26 within front 12 is estimated as the product of the length L of hitting zone 26 and the average height of hitting zone 26. Two representative heights, $H_1$ and $H_2$, illustrated. In other words, hitting zone 26 is the area within front 12 opposite to and coinciding with top portion 28 and reinforced portion 30 of the cavity back. The minimum thickness $t_1$ is measured within top portion 28. The defined aspect ratio covers hitting zone 26, where the area of top portion 28 makes up from about 50% to about 90%, more preferably from about 60% to about 80%, of the total area of hitting zone 26. The thickness of reinforced portion 30 can be about 1.2 times to about 3 times the thickness of top portion 28. The relative thickness between top portion 28, $t_1$, and reinforced portion 30, $t_2$, is illustrated in FIG. 15.

TABLE 3

Selected Parameters of Inventive Clubs

| | Loft° | Face Area of Front 12 (inch$^2$) | Hitting Zone 26 (inch$^2$) | Thickness (inch) | Aspect Ratio (inch) |
|---|---|---|---|---|---|
| | | Inventive Clubs | | | |
| 1 | 17.5 | 4.165 | 2.548 | 0.110 | 23.16 |
| 2 | 19.5 | 4.185 | 2.503 | 0.110 | 22.75 |
| 3 | 22.0 | 4.202 | 2.538 | 0.110 | 23.07 |
| 4 | 25.0 | 4.231 | 2.373 | 0.115 | 20.63 |
| 5 | 28.0 | 4.216 | 2.330 | 0.120 | 19.42 |
| 6 | 31.0 | 4.317 | 2.338 | 0.125 | 18.70 |
| 7 | 35.0 | 4.379 | 2.240 | 0.130 | 17.23 |
| 8 | 39.0 | 4.545 | 2.346 | 0.135 | 17.38 |
| 9 | 43.0 | 4.660 | 2.323 | 0.140 | 16.59 |
| PW | 47.0 | 4.755 | 2.345 | 0.145 | 16.17 |
| SW | 51.0 | 4.800 | 2.277 | 0.150 | 15.18 |
| | | Inventive Oversize Clubs | | | |
| 2 | 19.0 | 4.258 | 2.506 | 0.110 | 22.78 |
| 3 | 21.5 | 4.322 | 2.363 | 0.110 | 21.48 |
| 4 | 24.0 | 4.304 | 2.421 | 0.115 | 21.05 |
| 5 | 27.0 | 4.383 | 2.466 | 0.120 | 20.55 |
| 6 | 30.0 | 4.391 | 2.377 | 0.125 | 19.02 |
| 7 | 34.0 | 4.476 | 2.377 | 0.130 | 18.28 |
| 8 | 38.0 | 4.644 | 2.471 | 0.135 | 18.30 |
| 9 | 42.0 | 4.750 | 2.498 | 0.140 | 17.84 |
| PW | 46.0 | 4.864 | 2.528 | 0.145 | 17.43 |
| SW | 50.0 | 4.920 | 2.535 | 0.150 | 16.90 |

As used herein, club nos. 1-9, pitching wedge (PW) and sand wedge (SW) have common accepted descriptions used in the golf club art. A set of irons typically includes clubs ranging from 3-iron to PW or 5-iron to PW with other clubs being available for custom orders. It is also noted that a manufacturer can make different clubs within a set in different manners, such as cavity back/muscle-back sets. Iron-type clubs may also include a gap wedge. These clubs can also be described by other variables including, but not limited to, the loft angle. The areas of hitting zone 26 are plotted in FIG. 12, the minimum thicknesses of top portion 28 are plotted in FIG. 13 and the aspect ratios between the areas of hitting zone 26 and minimum thickness are plotted in FIG. 14. In FIGS. 12 and 14, Curves A illustrate the areas of hitting zone 26 and the aspect ratios for the inventive clubs and Curves B illustrate the areas of hitting zone 26 and aspect ratios for the inventive oversize clubs.

FIG. 12 illustrates large hitting zones for the inventive clubs and for the inventive oversize clubs, which are the results of having large face areas combined with large cavity volumes. FIG. 13 illustrates the thin single-piece stainless steel forged face having a minimum thickness of less than or equal to about 0.200 inch, and preferably the less than about 0.130 inch for clubs with LA of less than about 35°. FIG. 14 shows the aspect ratios (AR) of the clubs of the present invention, and the advantages of having a large hitting area and a thin face. The AR can be expressed as $$AR \geqq -((1/4.5) \times LA) + 25.$$

Curve C is the linear line representing this equation in FIG. 14.

Rotational moment of inertia ("inertia") in golf clubs is well known in art, and is fully discussed in many references, including U.S. Pat. No. 4,420,156, which is incorporated herein by reference in its entirety. When the inertia is too low, the club head tends to rotate excessively from off-center hits. Higher inertia indicates higher rotational mass and less rotation from off-center hits, thereby allowing off-center hits to fly farther and closer to the intended path. Inertia is measured about a vertical axis going through the center of gravity of the club head ($I_{yy}$), and about a horizontal axis about the center of gravity (CG) of the club head ($I_{xx}$), as shown in FIG. 1. The tendency of the club head to rotate around the y-axis through the CG indicates the amount of rotation that an off-center hit away from the y-axis causes. Similarly, the tendency of the club head to rotate in the around the x-axis through the CG indicates the amount of rotation that an off-center hit away from the x-axis through the CG causes. Most off-center hits cause a tendency to rotate around both x and y axes. High $I_{xx}$ and $I_{yy}$ reduce the tendency to rotate and provide more forgiveness to off-center hits.

Inertia is also measured about the shaft axis ($I_{sa}$), shown in FIG. 1. First, the face of the club is set in the address position, then the face is squared and the loft angle and the lie angle are set before measurements are taken. Any golf ball hit has a tendency to cause the club head to rotate around the shaft axis. An off-center hit toward the toe would produce the highest tendency to rotate about the shaft axis, and an off-center hit toward the heel causes the lowest. High $I_{sa}$ reduces the tendency to rotate and provides more control of the hitting face. High $I_{xx}$, $I_{yy}$ and $I_{sa}$ have been achieved in high-end cast iron-type clubs. This can now be realized in high-end forged iron-type clubs in accordance with the present invention.

As discussed above, the hitting zone of the club head can be as thin as about 0.100 inch for a 2-iron and about 0.150 inch for a sand wedge (SW). The weight is moved to the perimeter of the club head, and the sole can be as thick as about 0.540 inch to about 0.780 inch and the top can be as thick as about 0.180 inch to about 0.380 inch, preferably about 0.240 inch to about 0.320 inch. Exemplary inertias of the inventive clubs calculated by computer aided design (CAD) are shown below and compared to the inertia of a traditional forged muscle-back (with no perimeter weighting). The comparative clubs are the Titleist® 670 Forged Irons.

TABLE 4

| Rotational Moment of Inertia and Center of Gravity Measurements | | | | | | | | | |
|---|---|---|---|---|---|---|---|---|---|
| CAD-generated | Inventive Oversize Clubs | | | Inventive Clubs | | | Comparative Clubs | | |
| Club type | 3 | 6 | 9 | 3 | 6 | 9 | 3 | 6 | 9 |
| I-xx (kg-mm$^2$) | 52.7 | 56.5 | 70.0 | 50.5 | 55.7 | 70.7 | 47.3 | 54.6 | 72.8 |
| I-yy | 234.8 | 244.8 | 270.3 | 228.0 | 240.5 | 264.7 | 189.3 | 202.4 | 238.9 |
| I-sa | 526.6 | 595.2 | 662.5 | 472.2 | 536.7 | 608.6 | 389.4 | 435.3 | 488.3 |
| CG-y (mm) | 18.6 | 18.5 | 18.7 | 18.3 | 18.4 | 18.7 | 19.6 | 19.7 | 19.6 |
| CG-sa | 37.8 | 37.6 | 37.6 | 34.8 | 35.8 | 36.1 | 32.1 | 32.2 | 31.6 |
| weight (kg) | 0.243 | 0.261 | 0.283 | 0.241 | 0.260 | 0.282 | 0.240 | 0.259 | 0.281 |

* data created from CAD files.

As discussed above, the relative large cavity volumes of the inventive oversize clubs produce high rotational moments of inertia, particularly $I_{sa}$ and $I_{yy}$.

The locations of the center of gravity are also listed above. GC-y is measure from the ground when the club rests in the address position; CG-x is measured from the center of the face in the same position; and CG-sa is measured from the shaft axis in the same position. The center of gravity is located behind and below the geometric center of hitting face. The geometric center can be defined as the midpoint of the grooves or score lines, as stated above. It is readily apparent that the moments of inertia of the inventive clubs are higher than the moments of inertia of the comparative clubs.

Figure 16:
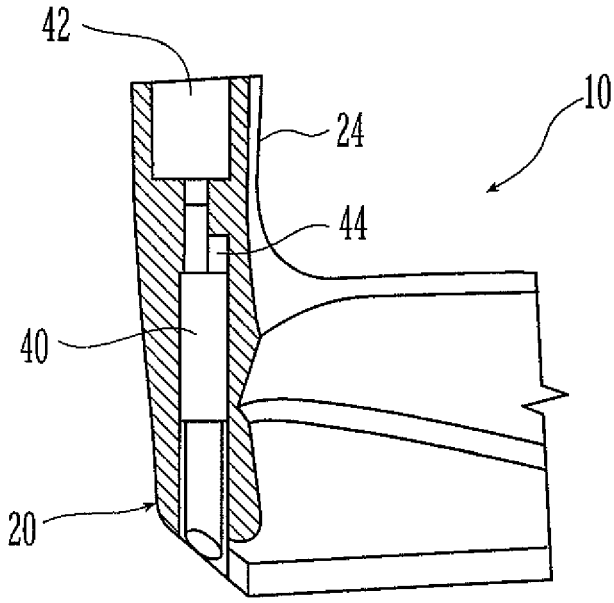
FIG. 16 is a partial cross-sectional side view of a club head in accordance with another embodiment of the present invention.
Figure 16A:
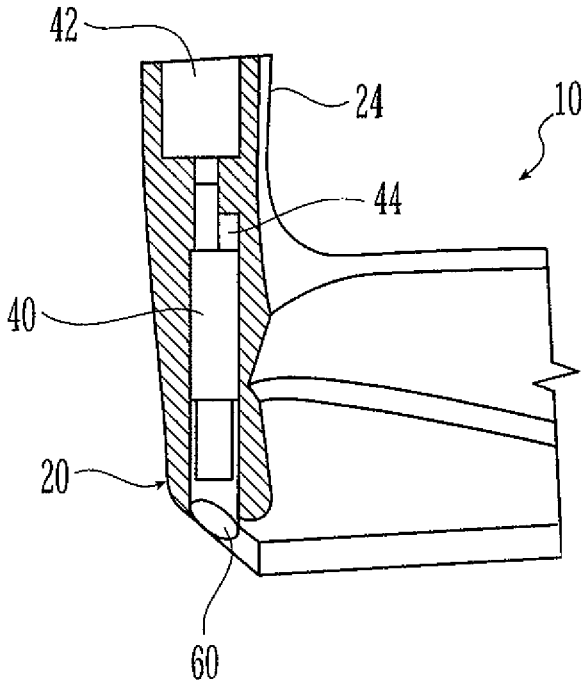
FIG. 16A is a partial cross-sectional side view of a club head in accordance with another embodiment of the present invention.
Figure 17:
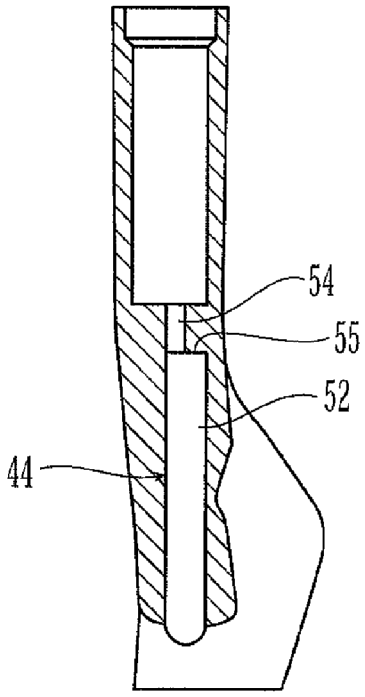
FIG. 17 is a rear cross-sectional view of the club head of FIG. 16 with the pin element removed.
Figure 18:
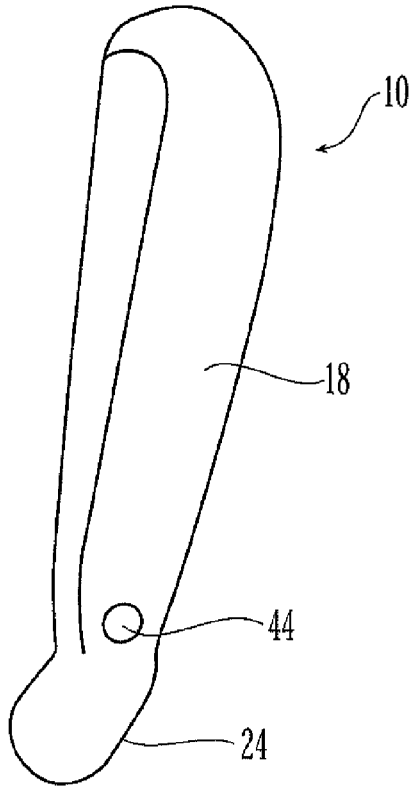
FIG. 18 is a bottom perspective view of the club head of FIG. 16.

In order to maintain a desired overall weight for club head 10 while providing additional material to increase the thickness of perimeter 32, material may be removed from any region of club head 10. FIGS. 16-20 show another embodiment of the present invention, where mass is taken from heel 20 for redistribution to another location in club head 10. In this embodiment, club head 10 includes a hosel 24, into which a club shaft 42 is inserted. As shown in FIGS. 16-18, material is removed from club head 10 to form a bore 44 that extends through heel 20 and a pin 40 is inserted within bore 44. Bore 44 preferably extends from the top of hosel 24 through sole 18. Bore 44 is preferably formed by drilling after club head 10 is manufactured, preferably by forging according to the embodiment discussed above.

Bore 44 includes a main channel 52 having a first diameter and a unitary upper channel 54 having a second diameter whose geometric center is offset from the geometric center of main channel 52. Both main channel 52 and upper channel 54 are preferably cylindrical, i.e., circular in cross-sectional shape, although other cross-sectional shapes such as elliptical or polygonal are also appropriate. The diameter of upper channel 54 is preferably much smaller than the diameter of main channel 52. For the purposes of example only, in one embodiment, the diameter of upper channel 54 preferably ranges from 1 mm to 5 mm, the diameter of main channel 52 ranges from 3 mm-10 mm. More preferably, the diameter of upper channel 54 is 2.5 mm and the diameter of main channel 52 is 5 mm. The transition from the larger diameter of main channel 52 to the smaller diameter of upper channel 54 is preferably an abrupt step, but may also be a gradual taper, or any other similar configuration.

A pin 40 is inserted into bore 44. Pin 40 fills much of the void formed by bore 44. Pin 40 preferably extends from sole 18 to a point within bore 44 below the bottom-most reach of shaft 42. A bottom surface 51 of pin 40 is preferably flush with an outer surface of sole 18, as shown in FIG. 16. Alternatively, if bottom surface 51 is not flush with the outer surface of sole 18, in other words, if pin 40 does not extend to the outer surface of sole 18, a cap made from a metal such as stainless steel or a polymer such as urethane may be affixed therewithin to create a flush surface.

Pin 40 is preferably solid, generally cylindrical in shape, and made from a lightweight material such as magnesium, aluminum, other lightweight metals, or low-density, high-strength polymers. In other words, pin 40 is made of a material that is less dense than that of the remainder of club head 10 so that the weight of club head 10 in the vicinity of hosel 24 is reduced. Alternatively, a heavier material may be used, such as steel or titanium, and pin 40 may be hollow. Pin 40 is preferably manufactured by casting, but may be made using any method known in the art, such as forging and milling. More preferably, pin 40 is made from a polymer material, such as STYLAC® ABS, available from the Asahi Kasei Chemical Corporation of Japan.

Figure 19:
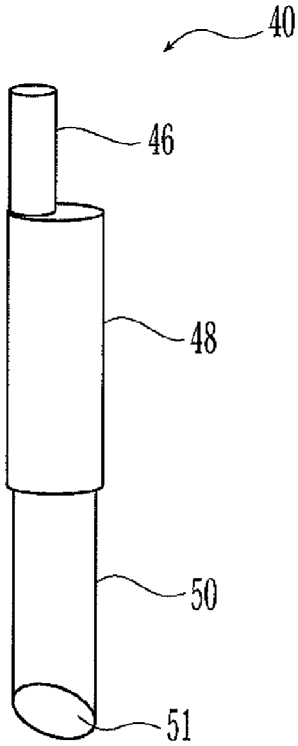
FIG. 19 is a perspective view of the pin element from the club head of FIG. 16.
Figure 20:
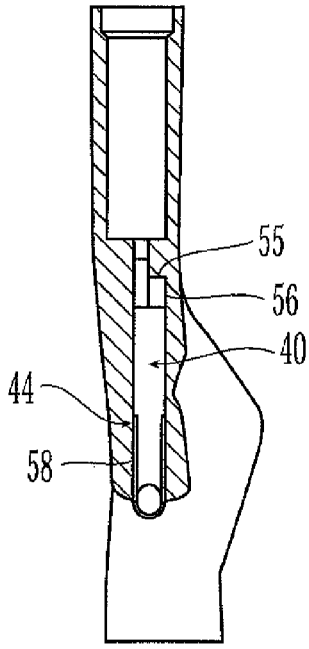
FIG. 20 is a rear cross-sectional view of the club head of FIG. 16.

As shown in FIGS. 19 and 20, the geometry of pin 40 generally mirrors the geometry of bore 44. Pin 40 preferably includes three cylindrical regions of dissimilar cross-sectional diameter: a pin extension 46, a pin body, 48, and a pin base 50. The outer diameter of pin body 48 is approximately equal to the diameter of main channel 52 of bore 44 so that pin 40 is held tightly within bore 44.

Pin extension 46 is preferably unitary with pin body 48 and extends from an upper surface of pin body 48. The outer diameter of pin extension 46 is smaller than the outer diameter of pin body 48 and is preferably significantly smaller than the outer diameter of pin body 48. For example, in one embodiment, the outer diameter of pin extension 46 is approximately equal to that of upper channel 54 of bore 44. For the purposes of example only, in one embodiments, the diameter of pin extension 46 ranges from 1 mm to 5 mm and the diameter of pin body 48 ranges from 3 mm to 10 mm. More preferably, the diameter of pin extension 46 is 2.3 mm and the diameter of pin body 48 is 4.8 mm. The transition from the larger diameter of pin body 48 to the smaller diameter of pin extension 46 is preferably an abrupt step, but may also be a gradual taper, or any other similar transitional configuration.

Pin extension 46 is preferably shorter in length than pin body 48. Pin extension 46 preferably has length sufficient to leave an upper gap 56 between an upper surface of pin body 48 and an upper shoulder 55 of bore 44. Upper gap 56 allows for vertical translation of pin 40 during manufacture so that a bottom surface 51 may be aligned with sole 18. As such, pin 40 may be used in the manufacture of any of a set of iron clubs without retooling pin 40 to fit within different clubs having slightly different configurations, such as length and/or the angle for the connection of club head 10 onto shaft 42.

Pin extension 46 is preferably eccentrically located with respect to pin body 48, i.e., the geometric center of pin extension 46 is preferably offset from the geometric center of pin body 48. In other words, the longitudinal axis of pin extension 46 does not coincide with the longitudinal axis of pin body 48. This preferred placement of pin extension 46 assists in proper positioning with respect to the rotational orientation of pin 40 within bore 44.

Pin 40 also preferably includes a pin base 50 which is a region having a third dissimilar outer diameter. Pin base 50 is preferably unitary with pin body 48 and preferably extends coaxially from a lower surface thereof. The outer diameter of pin base 50 is preferably only slightly smaller than the outer diameter of pin body 48. In other words, pin body 48 transitions to pin base 52 with a very small step or taper. Pin base 52 is configured to leave a lower gap 58 between an outer surface thereof and the inner wall of main channel 52. For example, if the outer diameter of pin body 48 is approximately equal to the diameter of main channel 52 of bore 44, then pin base 50 is configured such that lower gap 58 forms a clearance of 0.015 inch between the outer surface of pin base 50 and the inner wall of main channel 52.

Pin 40 is preferably affixed within bore 44 using a bonding agent such as flexible epoxy adhesive preferably having a cured hardness of less than approximately 63 Shore D. An example of an appropriate commercially available epoxy is DP-105 Clear Scotch-Weld™, available from 3M of St. Paul, Minn., which has a cured hardness of approximately 39 Shore D.

The epoxy adhesive preferably fills upper gap 56 and lower gap 58 to produce a dampening effect for transferring vibrations from club head 10 to shaft 42. The dampening effect is a result of the viscoelastic properties of the epoxy, which properties are a parasitic energy drain of the vibratory energy produced when club head 10 strikes golf balls. Even though the adhesive preferably surrounds pin 40 within bore 44, upper gap 56 and lower gap 58 contain a greater volume of adhesive than the rest of bore 44. As such, upper gap 56 and lower gap 58 are areas of greater dampening than the rest of bore 44.

In traditional muscle-back iron club constructions, the center of gravity (CG) of the club is inherently closer to the hosel. In other words, the CG is heel-ward of the face center (FC), a point defined as the midpoint of the scorelines a distance of 13.1826 mm (0.591 inches) above the ground plane, as measured when the club is soled in the address position. However, a more desirable location for the CG is toward the FC, so as to correspond more directly to the most likely ball impact locations.

Also, conventional muscle-back long irons have a CG that is relatively high, resulting in a lower flight pattern and less forgiveness on off-center hits. Therefore, a more desirable CG in the long irons is closer to the ground plane when the club is soled in the address position. In short irons for both muscle-back and cavity back clubs, the position of the CG is not generally as critical for overall club performance as other factors. As such, the position of the CG in short irons preferably falls within a desirable range.

FIG. 21 shows schematic front and bottom views of an iron club showing the CG, the FC, and various points of reference to describe with particularity the location of the CG.

Example 1

Muscle-Back Comparison. Table 5 compares the location of the CG in conventional muscle-back irons with muscle-back irons made in accordance with the embodiment of the present invention as shown in FIGS. 16-20. The conventional club is a Titleist 690MB, a forged stainless steel muscle-back club. Three club numbers were compared: the 3-iron, the 6-iron, and the 9-iron.

As is indicated in Table 5, the CG of the inventive muscle-back clubs are now generally closer to the FC than the conventional club due to the redistribution of mass from the bore and pin.

TABLE 5

Center of Gravity Location for Conventional, Inventive MB Clubs

| Club and Type | CG-A (mm) | CG-B (mm) | CG-C (mm) | CG-x-fc (mm) | CG-y-fc (mm) | CG-z-fc (mm) | CG-y-g (mm) |
|---|---|---|---|---|---|---|---|
| 690MB 3 | 67.3 | 33.04 | −5.51 | 4.42 | 4.54 | −4.28 | 19.54 |
| Inventive MB Club 3 | 62.61 | 34.29 | −6.01 | 1.52 | 3.98 | −4.95 | 18.98 |
| Difference | 4.82 | −1.25 | 0.51 | 2.90 | 0.56 | 0.67 | 0.56 |
| 690MB 6 | 65.98 | 33.22 | −7.96 | 3.92 | 3.99 | −4.32 | 18.99 |
| Inventive MB Club 6 | 61.59 | 34.81 | −7.69 | 0.33 | 3.71 | −5.53 | 18.71 |
| Difference | 4.39 | −1.59 | −0.27 | 3.59 | 0.28 | 4.57 | 26.52 |
| 690MB 9 | 65.88 | 33.07 | −12.09 | 3.96 | 3.56 | −4.82 | 18.56 |
| Inventive MB Club 9 | 64.21 | 34.99 | −11.34 | 0.99 | 4.01 | −6.37 | 19.01 |
| Difference | 1.67 | −1.92 | −0.75 | 2.97 | −0.44 | 1.55 | −0.44 |

Table 6 shows the moments of interia for each of these clubs. As discussed above, the location of the CG influences inertia. The inertia is measured as described above around various axes of the club head. Higher rotational moments of inertia indicate higher rotational mass and less rotation from off-center hits, thereby allowing off-center hits to fly farther and closer to the intended path. As shown in Table 6, the inventive club has increase inertia compared to the conventional club.

TABLE 6

Moments of Inertial for Conventional, Inventive Clubs

| Club and Type | $I_{xx}$ (kg * mm^2) | $I_{yy}$ (kg * mm^2) | $I_{zz}$ (kg * mm^2) | $I_{sa}$ (kg * mm^2) |
|---|---|---|---|---|
| 690MB 3 | 43.1 | 190.2 | 222.6 | 434.7 |
| Inventive Club MB 3 | 46.1 | 214.6 | 249.5 | 418.6 |
| Difference | 2.93 | 24.49 | 26.94 | −16.15 |
| 690MB 6 | 49.2 | 198.9 | 227.3 | 485.8 |
| Inventive MB Club 6 | 53.8 | 225.1 | 255.4 | 465.0 |

TABLE 6-continued

Moments of Inertial for Conventional, Inventive Clubs

| Club and Type | $I_{xx}$ (kg * mm^2) | $I_{yy}$ (kg * mm^2) | $I_{zz}$ (kg * mm^2) | $I_{sa}$ (kg * mm^2) |
|---|---|---|---|---|
| Difference | 4.57 | 26.52 | 27.85 | −20.77 |
| 690MB 9 | 65.1 | 226.9 | 246.7 | 537.0 |
| Inventive MB Club 9 | 67.9 | 239.6 | 259.9 | 519.1 |
| Difference | 2.84 | 12.79 | 13.23 | −17.93 |

Example 2

Cavity Back Comparison. Table 7 compares the location of the CG in a cavity back iron with a cavity back iron made in accordance with the embodiment of the present invention as shown in FIGS. 16-20. The comparative club is a Titleist® 704CB, a forged stainless steel cavity back club. The 3-iron for each club set was tested for comparison.

As is indicated in Table 7, the CG of the inventive cavity back club is now generally closer to the FC than that of the 704CB club due to the redistribution of mass from the bore and pin.

TABLE 7

Center of Gravity Location for 704CB, Inventive Clubs

| Club and Type | CG-A (mm) | CG-B (mm) | CG-C (mm) | CG-x-fc (mm) | CG-y-fc (mm) | CG-z-fc (mm) | CG-y-g (mm) |
|---|---|---|---|---|---|---|---|
| 704CB 3 | 65.56 | 34.19 | −6.87 | 2.85 | 3.64 | −4.88 | 18.64 |
| Inventive CB Club 3 | 62.83 | 35.26 | −6.88 | 1.47 | 3.47 | −4.96 | 18.47 |
| Difference | 2.73 | 1.07 | 0.01 | 0.38 | −0.17 | 0.08 | −0.17 |

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A golf club head comprising a hosel configured to receive a club shaft and a bore extending from the hosel to a sole of the club head and a shoulder disposed at a lower end of the hosel and spaced from the sole, wherein the club head is made from forged stainless steel, wherein the density of a pin disposed in the bore between the lower end of the hosel and the sole is less than the density of the club head, wherein the club head includes a shaft axis and a center of gravity and the distance therebetween is between 37.6 mm and 37.8 mm, and wherein the bore includes an upper portion and a main portion and the upper portion is eccentrically located relative to the main portion.

2. The golf club head of claim 1, wherein at least two dampening zones are defined in the bore.

3. The golf club head of claim 2, wherein the pin and the bore are sized and configured to define the at least two dampening zones.

4. The golf club head of claim 2, wherein a flexible epoxy surrounds the pin.

5. A golf club head comprising:

a hosel attached to a heel of the club head; and a bore disposed in the heel of the club head, wherein the bore extends from the hosel through a sole of the club head, and wherein the bore is sized and dimensioned to receive an elongated pin, wherein the pin is positioned within the bore such that an upper gap is formed between an upper surface of the pin and an upper shoulder of the bore such that the entire pin is spaced toward the sole from a lower end of the hosel, wherein the club has a rotational moment of inertia about a shaft axis that is between 595.2 kg*mm$^2$ and 662.5 kg*mm$^2$, and wherein the upper extension outer diameter is smaller than the lower base outer diameter.

6. The golf club head according to claim 5, wherein a lower gap is formed between a lower base of the pin and an inner wall of the bore.

7. The golf club head according to claim 6, wherein the lower gap is filled with adhesive.

8. The golf club head according to claim 5, wherein the pin is solid.

9. The golf club head according to claim 5, wherein the pin is hollow.

10. The golf club head according to claim 5, wherein the pin is made of a material selected from the group consisting of magnesium, aluminum, and a polymer.

11. The golf club head according to claim 5, wherein the upper gap is filled with a flexible epoxy.

12. The golf club head according to claim 5, wherein a pin bottom surface is flush with an outer surface of the sole.

13. The golf club head according to claim 5, wherein a pin bottom surface does not extend to an outer surface of the sole.

14. The golf club head according to claim 13, wherein a cap is inserted into the bore.

15. The golf club head according to claim 5, wherein the pin is asymmetric and the bore is asymmetric such that the pin fits into the bore in a specific orientation.

16. A golf club head comprising:

a hosel attached to a heel of the club head; and a bore disposed in the heel of the club head, wherein the bore extends from the hosel through a sole of the club head, and wherein the bore is sized and dimensioned to receive an elongated pin, wherein the pin is positioned within the bore such that an upper gap is formed between an upper surface of the pin and an upper shoulder of the bore such that the entire pin is spaced toward the sole from a lower end of the hosel, wherein the club has a rotational moment of inertia about a shaft axis that is between 595.2 kg*mm$^2$ and 662.5 kg*mm$^2$, and wherein the pin is asymmetric and the bore is asymmetric such that the pin fits into the bore in a specific orientation.

* * * * *